US008395578B2

(12) United States Patent
Nishigaki

(10) Patent No.: US 8,395,578 B2
(45) Date of Patent: Mar. 12, 2013

(54) BACKLIGHT UNIT AND LIQUID-CRYSTAL DISPLAY DEVICE USING THE SAME

(75) Inventor: Eitaro Nishigaki, Kanagawa (JP)

(73) Assignee: NLT Technologies, Ltd., Kanagawa (JP)

( * ) Notice: Subject to any disclaimer, the term of this patent is extended or adjusted under 35 U.S.C. 154(b) by 861 days.

(21) Appl. No.: 12/059,672

(22) Filed: Mar. 31, 2008

(65) Prior Publication Data

US 2008/0238863 A1 Oct. 2, 2008

(30) Foreign Application Priority Data

Mar. 30, 2007 (JP) ..... 2007-091247

(51) Int. Cl.
*G09G 3/36* (2006.01)

(52) U.S. Cl. ..... 345/102; 345/87; 345/93; 345/98; 345/99; 345/100

(58) Field of Classification Search ..... 345/77, 345/87–102, 204, 207, 690; 313/498; 349/65, 349/106, 108, 114, 119, 68; 315/308; 362/609–616, 362/231
See application file for complete search history.

(56) References Cited

U.S. PATENT DOCUMENTS

| | | | | |
|---|---|---|---|---|
| 7,256,763 | B2 * | 8/2007 | Kaneki et al. | 345/102 |
| 7,319,446 | B2 * | 1/2008 | Oh et al. | 345/76 |
| 7,460,103 | B2 * | 12/2008 | Konno et al. | 345/102 |
| 7,530,722 | B2 * | 5/2009 | Murai | 362/613 |
| 7,656,371 | B2 * | 2/2010 | Shimizu et al. | 345/83 |
| 2003/0156128 | A1 * | 8/2003 | Ito | 345/690 |
| 2004/0252097 | A1 * | 12/2004 | Kaneki et al. | 345/102 |
| 2005/0184952 | A1 * | 8/2005 | Konno et al. | 345/102 |
| 2005/0259061 | A1 * | 11/2005 | Aoki | 345/96 |

(Continued)

FOREIGN PATENT DOCUMENTS

| | | | |
|---|---|---|---|
| JP | 2001236034 | A | 8/2001 |
| JP | 2002343596 | A | 11/2002 |

(Continued)

OTHER PUBLICATIONS

Japanese Office Action dated Mar. 1, 2012 issued by the Japanese Patent Office in corresponding Japanese Patent Application No. 2007-091247.

*Primary Examiner* — Prabodh M Dharia
(74) *Attorney, Agent, or Firm* — Sughrue Mion, PLLC

(57) ABSTRACT

A backlight unit shortens the necessary time from the time immediately after the turn on to the time the emitted light is converged to a predetermined chromaticity while the quality of time-varying images is improved. Under the control of the backlight controller section, the Light-Emitting Diodes (LEDs), which are assigned to the respective light-emitting regions of the light-emitting surface, are driven to emit lights sequentially in the predetermined scanning light-emitting periods for the scan type lighting and the additional light-emitting periods in a single frame, responsive to the write scanning of an image signal to the LCD panel. The additional light-emitting periods are outside a corresponding one of the scanning light-emitting periods. In each additional light-emitting period, the LEDs emit light in synchronization with the supply of the optical leakage preventing signal (e.g., the black inserting signal) to the LCD panel.

9 Claims, 7 Drawing Sheets

U.S. PATENT DOCUMENTS

| | | | | |
|---|---|---|---|---|
| 2006/0022616 | A1* | 2/2006 | Furukawa et al. | 315/309 |
| 2006/0114199 | A1* | 6/2006 | Kim | 345/77 |
| 2006/0125742 | A1* | 6/2006 | Sekiguchi et al. | 345/80 |
| 2006/0125773 | A1 | 6/2006 | Ichikawa et al. | |
| 2006/0232217 | A1* | 10/2006 | Oh et al. | 315/169.3 |
| 2006/0279507 | A1* | 12/2006 | Nakao et al. | 345/98 |
| 2007/0064422 | A1* | 3/2007 | Murai | 362/231 |
| 2007/0080923 | A1* | 4/2007 | Enomoto et al. | 345/102 |
| 2007/0091056 | A1* | 4/2007 | Okita et al. | 345/102 |
| 2007/0120496 | A1* | 5/2007 | Shimizu et al. | 315/169.3 |
| 2007/0170449 | A1* | 7/2007 | Anandan | 257/98 |
| 2008/0297461 | A1* | 12/2008 | Hsu et al. | 345/102 |
| 2011/0285763 | A1* | 11/2011 | Bassi et al. | 345/694 |

FOREIGN PATENT DOCUMENTS

| | | | |
|---|---|---|---|
| JP | 2004004659 | A | 1/2004 |
| JP | 2004-163829 | A | 6/2004 |
| JP | 2004252127 | A | 9/2004 |
| JP | 2005258404 | A | 9/2005 |
| JP | 2006018200 | A | 1/2006 |
| JP | 2006-171693 | A | 6/2006 |
| TW | 256032 | B | 6/2006 |

* cited by examiner

BLACK INSERTING SIGNAL

SCANNING LIGHT -EMITTING SIGNAL

LED DRIVING SIGNAL

LED DRIVING SIGNAL (PWM)

BLACK INSERTING SIGNAL

SCANNING LIGHT -EMITTING SIGNAL

LED DRIVING SIGNAL

BACKLIGHT UNIT AND LIQUID-CRYSTAL DISPLAY DEVICE USING THE SAME

The present Application claims priority from Japanese Patent Application No. 2007-091247, filed in the Japanese Patent Office on Mar. 30, 2007.

BACKGROUND OF THE INVENTION

1. Field of the Invention

The present invention relates to a backlight unit and a Liquid-Crystal Display (LCD) device and more particularly, to a backlight unit structured to emit light intermittently from the light source, and a LCD device equipped with the backlight unit.

2. Description of the Related Art

In recent years, the LCD device has been extensively used as a high-resolution display device. The LCD device comprises a substrate on which switching elements such as Thin-Film Transistors (TFTs) are formed (which will be termed the "TFT substrate" below), another substrate on which a color filter and a black matrix are formed (which will be termed the "opposite substrates" below), and a liquid crystal layer sandwiched between the TFT substrate and the opposite substrate. An electric field is applied across the electrodes formed on the TFT substrate and those formed on the opposite substrate, or across the electrodes formed on the TFT substrate and the other electrodes formed on the said TFT substrate, thereby changing the alignment direction of the liquid crystal molecules in the liquid crystal layer. In this way, the amount of the transmitted light is controlled in each pixel to display desired images. The structure formed by the TFT substrate, the opposite substrate, and the liquid-crystal layer placed therebetween is termed the LCD panel.

With the transmissive type LCD device, a backlight unit is mounted on the back of the LCD panel, where the light emitted from the backlight unit is irradiated to the LCD panel from its back. As the light source for the backlight unit, conventionally, Cold Cathode Fluorescent Tubes (CCFLs) were being generally used. However, recently, the use of Light-Emitting Diodes (LEDs) has been increasing. In this case, many red, green and blue LEDs are used in combination to perform color mixture optically, thereby generating white light. The white light thus generated is irradiated to the LCD panel.

With the LCD devices comprising the backlight unit into which LEDs are incorporated, white light with a constant chromaticity needs to be generated at all times. Therefore, the driving currents supplied respectively to the red, green, and blue LEDs are feedback-controlled in such a way that the red, green, and blue lights from the respective LEDs are always mixed at a constant ratio, while the quantity of the light of each color is detected. If this feedback control is performed at high speed, the change of the chromaticity will be recognized by the user and therefore, it is performed at comparatively low speed. For this reason, the chromaticity is not adjusted as desired and as a result, there arises a phenomenon that some colors different from white are displayed on the screen at the time immediately after the turn on of the LCD device and thereafter, these non-white colors will be gradually turned to white. To suppress this phenomenon, conventionally, the driving currents for the red, green, and blue LEDs are respectively set at their predetermined initial values at the time immediately after the turn on of the LCD device.

On the other hand, it is general that the temperature of a LED at the time immediately after the turn on and that in the steady-state operation thereof are widely different, and that the optical characteristics of a LED varies greatly dependent on the temperature. Therefore, a LED has a disadvantage that it takes a long time from the time immediately after the turn on to the time when the emitted white light is converged to a predetermined chromaticity. A LCD device that has overcome the said disadvantage is disclosed in the Patent Document 1 (the Japanese Non-Examined Patent Publication No. 2006-171693) published in 2006. This LCD device is shown in FIG. 1.

FIG. 1 is a functional block diagram showing the structure of the prior-art LCD device 100 disclosed in the Patent Document 1.

The prior-art LCD device 100 of FIG. 1 comprises a transmissive type color LCD panel 103 and a backlight unit 112. The LCD panel 103 is driven by a X driver circuit 106 and a Y driver circuit 107. The backlight unit 112 comprises a light source 110 using red, green, and blue LEDs, and a wavelength selection filter 111, where the LEDs of each color are driven by a driver section 113. The temperatures of the LEDs are detected by temperature sensors 114. The chromaticity of the white light emitted from the LEDs is detected by chromaticity sensor 115 serving as a photosensor.

When an image signal is inputted into the LCD device 100 by way of an input terminal 101, the image signal is subjected to a predetermined signal process such as the chroma process in a RGB process controller 102 and then, it is converted to RGB separated signals which are suitable for driving the LCD panel 103. The RGB separated signals thus generated are supplied to a controller section 104 and at the same time, they are supplied to the X driver circuit 106 too by way of an image memory 105. The controller section 104 controls the X and Y driver circuits 106 and 107 with predetermined timing that is in accordance with the RGB separated signals received, and drives the LCD panel 103 using the RGB separated signals supplied to the X and Y driver circuits 106 and 107 by way of the image memory 105. In this way, images are displayed on the screen of the LCD panel 103 according to the RGB separated signals.

The driver section 113 supplies the predetermined currents to the respective LEDs of the light source 110 to drive them. At the same time as this, the driver section 113 feedback-controls the electric current quantities for the LEDs of each color based on the detected value of the chromaticity sensor 115, thereby adjusting the white light to the predetermined chromaticity value. Moreover, the driver section 113 reads the initial current values for the LEDs of each color at the turn on from a nonvolatile memory 116, compensates the initial current values thus read corresponding to the detected temperature values of the temperature sensors 114, and activates the LEDs of each color using the initial current values thus compensated.

With the prior-art LCD device 100 shown in FIG. 1, because the above-described structure is provided, the LEDs of each color can be activated to have their predetermined chromaticities from the time immediately after the turn on regardless of the temperatures of the LEDs at the turn on. Accordingly, the necessary time from the time immediately after the turn on to the time the emitted lights from the LEDs are converged to their predetermined chromaticities (i.e., from the time immediately after the turn on to the time white light with the predetermined chromaticity is generated stably) can be shortened. (See FIG. 4 and Abstract of the Patent Document 1.)

Moreover, a LCD device has a disadvantage that if a moving or time-varying image (or animation) is displayed, the contours of the moving parts are seen blurred. A LCD device where this disadvantage of the "contour blur of time-varying images" is relaxed is disclosed in the Patent Document 2 (the Japanese Non-Examined Patent Publication No. 2004-163829) published in 2004. This LCD device is shown in FIG. 2.

FIG. 2 is a functional block diagram showing the structure of the prior-art LCD device 150 disclosed in the Patent Document 2.

The prior-art LCD device 150 comprises a LCD panel 158 having data electrodes and scanning electrodes, an electrode driver section 151 for driving the data and scanning electrodes of the panel 158, a backlight unit 162 as a light source for irradiating light to the panel 158 from its back, and a light-source driver 161 for on-off driving the backlight unit 162 intermittently within a single vertical period.

An input image signal is delayed by the time corresponding to one frame period in a delayer section 156 and then, sent to a frame frequency converter section 152. The frame frequency converter section 152 converts the frame frequency of the input image signal thus delayed to a high frequency and outputs the input image signal thus converted to the electrode driver section 151. The electrode driver section 151 drives the data and scanning electrodes of the LCD panel 158 according to the input image signal thus received, thereby displaying images corresponding to the said input image.

A synchronizing signal extractor section 160 extracts the vertical synchronizing signal from the input image signal and supplies it to the light-source driver 161. The light-source driver 161 drives the backlight unit 162 based on the vertical synchronizing signal thus received, thereby turning on and off the backlight unit 162 within a single vertical period for the intermittent operation thereof.

A temperature detector section 153 detects the temperature of the inside of the LCD device 150. A frame memory (FM) 154 stores preceding frame data. A control CPU (Central Processing Unit) 155 detects the gradation transition between the current frame data and the preceding frame data which has been read from the frame memory 154, and outputs a predetermined control signal to the frame frequency converter section 152 based on the gradation transition of the above-described input image signal between the prior frame and the current frame and that between the current frame and the subsequent frame, and the temperature data detected by the temperature detector 153.

In response to the control signal outputted from the control CPU 155, the frame frequency converter section 152 converts the frame frequency of the input image signal to, for example, a higher frequency, thereby shortening the scanning period in one frame period to increase the liquid-crystal response period. For this reason, even if an image accompanying the gradation transition where the liquid-crystal response speed is low is inputted into the LCD device 150, the length of the liquid-crystal response period can be made satisfactory. As a result, the said image can be displayed after the liquid-crystal molecules have responded completely and the brightness of the emitted light has reached the target value thereof.

The backlight unit 162 has two types of lighting, i.e., the "global flash" type and the "scan" type. With the "global flash" type lighting, the backlight unit 162 is globally or entirely turned on and off. On the other hand, with the "scan" type lighting, the light-emitting surface of the backlight unit 162 is divided into a plurality of light-emitting regions in advance, and the light is sequentially emitted from the respective light-emitting regions in a predetermined order corresponding to the write scanning of the image signal.

With the prior-art LCD device 150 shown in FIG. 2, since the above-described structure is provided, not only the contour blur of time-varying images but also the afterimage thereof can be suppressed and therefore, high-quality time-varying images can be displayed, (See Abstract, FIGS. 1 to 3 and paragraphs 0032 to 0041 of the Patent Document 2.)

In addition, the Patent Document 2 discloses another structure that makes it possible to display high-quality time-varying images similar to that realized by the structure shown in FIG. 2 in the method where the write scanning for a black display signal (i.e., the reset scanning) is carried out subsequent to the write scanning of the image signal in one frame. With this structure, the image display period (i.e., the black display period) is controlled in response to the gradation transition of an image signal between the prior frame and the current frame and that between the current frame and the subsequent frame. Even if an image accompanying the gradation transition where the liquid-crystal response speed is low is inputted, the length of the liquid-crystal response period can be made satisfactory, and as a result, the said image can be displayed after the liquid-crystal molecules have responded completely and the brightness of the emitted light has reached the target one thereof. (See FIGS. 8 to 10 and paragraphs 0090 to 0098 of the Patent Document 2.)

To converge the emitted white light to a predetermined chromaticity within a short time while improving the quality of time-varying images in the above-described prior-art LCD device 150 explained with reference to FIG. 2, the structure of the above-described prior-art LCD device 100 shown in FIG. 1 may be used in combination. Concretely speaking, the structure of the LCD device 100 of FIG. 1 that the current quantity for the LEDs of each color is feedback-controlled based on the quantity of the received light of the chromaticity sensor 115 may be combined with the structure of the LCD device 150 of FIG. 2 that the backlight unit 162 is operated intermittently within one frame in such a way that white light having a predetermined chromaticity is emitted. In this case, it seems that the emitted white light may be converged to the predetermined chromaticity within a short time while the quality of time-varying images is improved.

However, if such the combination as above is adopted, the light-emitting period of each LED will be shortened. This is because the LEDs of the backlight unit 162 are operated intermittently in one frame (i.e., the LEDs are partitioned into n groups and operated sequentially) in the LCD device 150 of FIG. 2. Therefore, the quantities of the lights emitted from the respective LEDs the chromaticity sensor 115 receives, which performs the integration of the waveforms of the received lights and the outputting of the result of the integration, will reduce to a fraction of the number (a) of time division, i.e., (1/n), compared with the LCD device 100 where the scanning operation is not carried out.

As a result, there arise the above-described problem of the LCD device 100 of FIG. 1 that it takes a long time from the time immediately after the turn on to the time the emitted white light is converged to the predetermined chromaticity, and another problem that a large chromaticity error will occur when the convergence of the emitted lights is competed.

SUMMARY OF THE INVENTION

The present invention was created in consideration of the above-described problems.

An object of the present invention is to provide a backlight unit that shortens the necessary time from the time immediately after the turn on to the time the emitted white light is converged to the predetermined chromaticity while improving the quality of time-varying images.

Another object of the present invention is to provide a LCD device that prevents the colors displayed on the screen from being inappropriate at the time immediately after the turn on while improving the quality of time-varying images.

The above objects together with others not specifically mentioned will become clear to those skilled in the art from the following description.

According to the first aspect of the present invention, a backlight unit is provided, which comprises;

a light source including LEDs of three or more colors, the LEDs being assigned to a plurality of light-emitting regions;

a chromaticity sensor for detecting a chromaticity of white light generated by the LEDs;

a light-source driver section for driving the LEDs; and a backlight controller section for adjusting white light generated by the LEDs to have a predetermined chromaticity based on a detected chromaticity value by the chromaticity sensor;

wherein under control of the backlight controller section, the LEDs are driven to emit lights sequentially in respective predetermined scanning light-emitting periods in a single frame and in respective additional light-emitting periods in the same frame responsive to write scanning of an image signal to a LCD panel, the additional light-emitting periods being outside a corresponding one of the scanning light-emitting periods; and light emission of the LEDs in each of the additional light-emitting periods is performed in synchronization with supply of an optical leakage preventing signal to the LCD panel.

With the backlight unit according to the first aspect of the present invention, the LEDs emit lights sequentially in the respective predetermined scanning light-emitting periods in a single frame and in the respective additional light-emitting periods in the same frame responsive to the write scanning of an image signal to a LCD panel. The additional light-emitting periods are outside a corresponding one of the scanning light-emitting periods. The above operation is performed under control of the backlight controller section. Therefore, the quantities of the lights emitted from the LEDs will be greater than the case where the LEDs are driven to simply perform the scanning operation.

For this reason, when the chromaticity sensor detects the chromaticity of the white light generated by the LEDs and then, the backlight controller section adjusts the said white light based on the chromaticity value obtained by the chromaticity sensor, the chromaticity value obtained by the chromaticity sensor will be higher. This means that the necessary time for the chromaticity adjustment is shortened.

Accordingly, even if the LEDs are sequentially driven to conduct the scanning type light emission, the problem that it takes a long time from the time immediately after the turn on to the time the emitted lights are converged to the predetermined chromaticity does not occur. In addition, the problem that a large chromaticity error will be observed when the convergence of the emitted lights is completed does not occur also.

Moreover, since the light emission of the LEDs in each of the additional light-emitting periods is performed in synchronization with the supply of the optical leakage preventing signal to the LCD panel, the light emission do not cause any problem.

As a result, the necessary time from the time immediately after the turn on to the time the emitted white light is converged to the predetermined chromaticity can be shortened while the quality of time-varying images is improved.

In a preferred embodiment of the backlight unit according to the first aspect of the invention, each of the additional light-emitting periods is defined based on a black signal period where a black inserting signal for causing the LCD panel to display black is generated. In this embodiment, there is an additional advantage that the light emission of the LEDs in the respective additional light-emitting periods in synchronization with the supply of the optical leakage preventing signal is easily realized.

In another preferred embodiment of the backlight unit according to the first aspect of the invention, each of the additional light-emitting periods is set to be equal to a black signal period where a black inserting signal for causing the LCD panel to display black is generated. In this embodiment, there is an additional advantage that the light emission of the LEDs in the respective additional light-emitting periods in synchronization with the supply of the optical leakage preventing signal is realized more easily.

In still another preferred embodiment of the backlight unit according to the first aspect of the invention, each of the additional light-emitting periods is defined to be variable based on a black signal period where a black inserting signal for causing the LCD panel to display black is generated, and each of the additional light-emitting periods is set to be equal to or shorter than the black signal period as necessary. In this embodiment, since the length of each of the additional light-emitting periods can be adjusted using the Pulse Width Modulation (PWM) technique, there is an additional advantage that the light emission of the LEDs in the respective additional light-emitting periods can be controlled more precisely to thereby facilitate the attainment of white balance.

In a further preferred embodiment of the backlight unit according to the first aspect of the invention, each of the additional light-emitting periods is defined based on a black signal period where a black inserting signal for causing the LCD panel to display black is generated, and one of the additional light-emitting periods corresponds to a plurality of the black signal periods. In this embodiment, there is an additional advantage that the repetition frequency of the additional light-emitting periods can be easily reduced without changing the black signal period and the repetition frequency thereof.

In a still further preferred embodiment of the backlight unit according to the first aspect of the invention, the LEDs of the light source include red, green, and blue LEDs, and the red LEDs, the green LEDs, and the blue LEDs are respectively driven to emit lights separately in different frames.

In a still further preferred embodiment of the backlight unit according to the first aspect of the invention, the LEDs of the light source include red, green, and blue LEDs, and the red LEDs, the green LEDs, and the blue LEDs are respectively driven to emit lights in the same frame.

In a still further preferred embodiment of the backlight unit according to the first aspect of the invention, waveforms of signals for driving the LEDs are equal to waveforms generated by a logical OR operation between waveforms for causing the LEDs to emit lights sequentially in the respective predetermined scanning light-emitting periods responsive to the write scanning of an image signal to the LCD panel, and a waveform of a black inserting signal for causing the LCD panel to display black. In this embodiment, there is an additional advantage that the signals for driving the LEDs can be easily generated.

According to the second aspect of the present invention, a LCD device is provided, which comprises:

the backlight unit according to the first aspect of the present invention.

With the LCD device according to the second aspect of the present invention, because the backlight unit according to the first aspect of the invention is included, the problem that the colors displayed on the screen will be inappropriate at the time immediately after the turn on can be prevented while the quality of time-varying images is improved.

BRIEF DESCRIPTION OF THE DRAWINGS

In order that the present invention may be readily carried into affect, it will now be described with reference to the accompanying drawings.

DETAILED DESCRIPTION OF THE PREFERRED EMBODIMENTS

Figure 1:
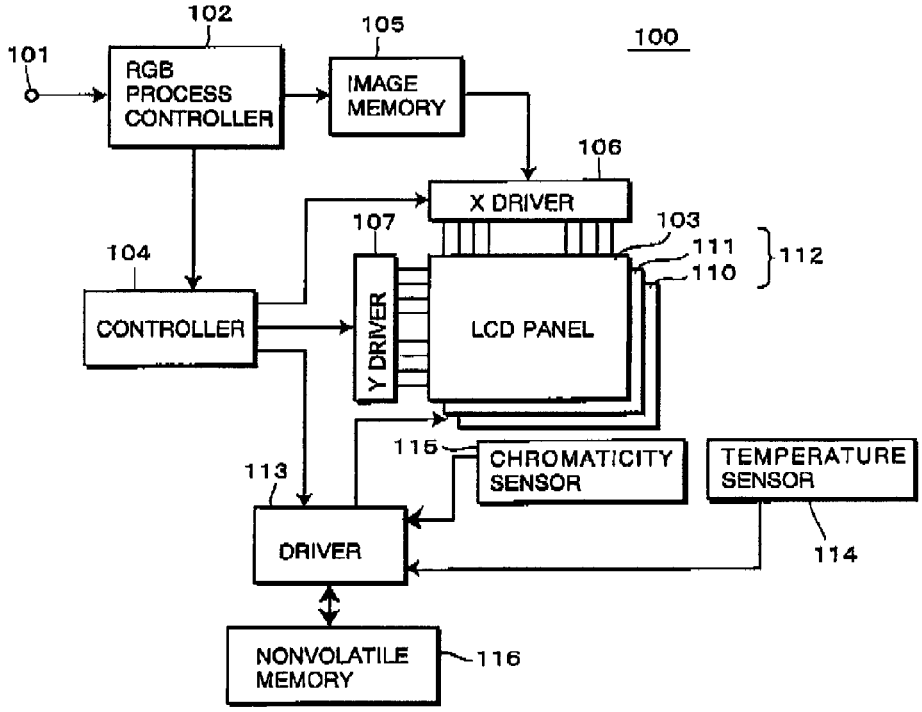
FIG. 1 PRIOR ART
FIG. 1 is a functional block diagram showing an example of the circuit configuration of a prior-art LCD device.
Figure 2:
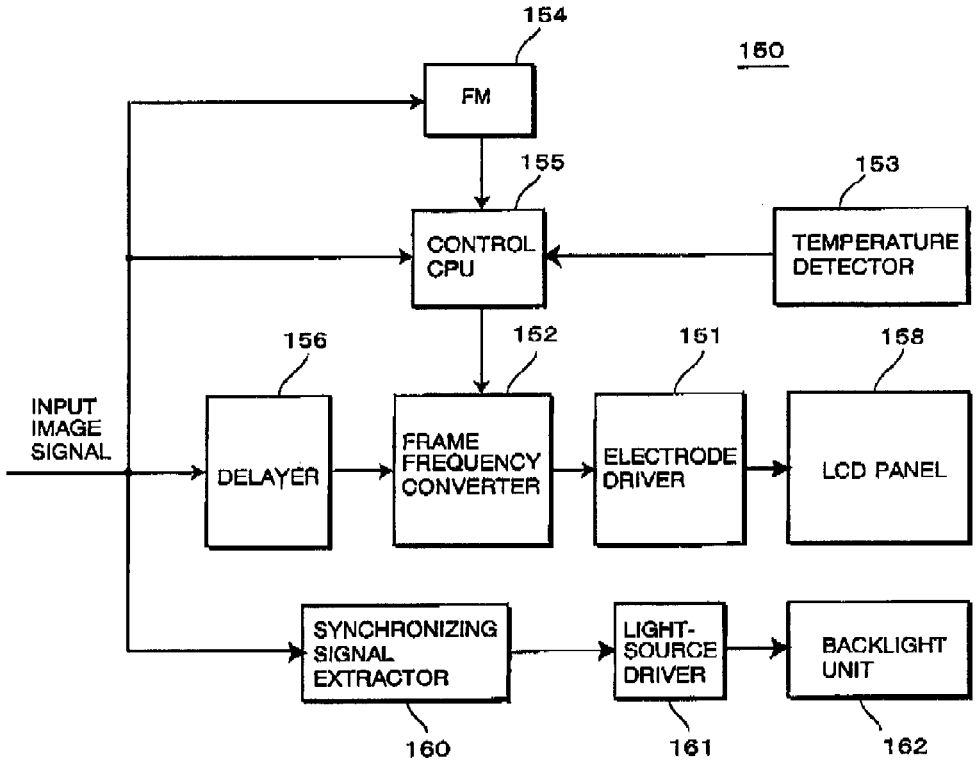
FIG. 2 PRIOR ART
FIG. 2 is a functional block diagram showing another example of the circuit configuration of a prior-art LCD device.

Preferred embodiments of the present invention will be described in detail below while referring to the drawings attached.

First Embodiment

Figure 3:
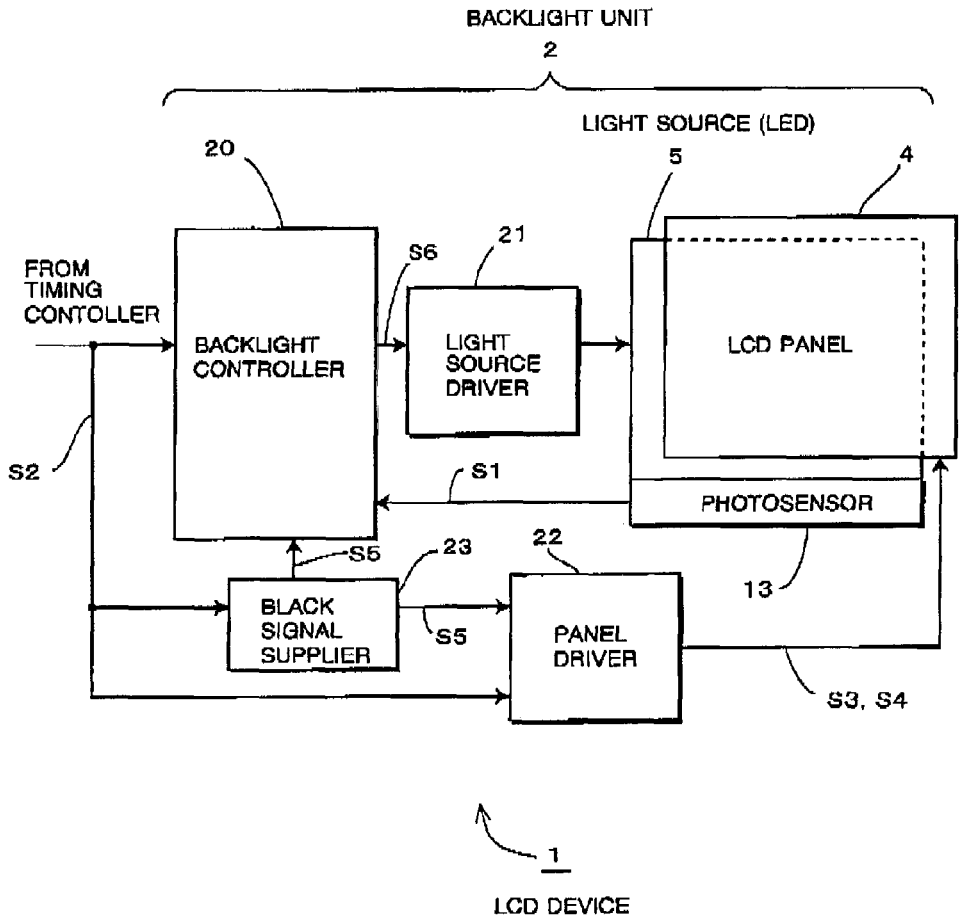
FIG. 3 is a functional block diagram showing the structure of a LCD device into which a backlight unit according to a first embodiment of the present invention is incorporated.

The structure of a LCD device 1 into which a backlight unit 2 according to a first embodiment of the invention is incorporated is shown in FIG. 3.

The LCD device 1 comprises a LCD panel 4 constituted by a TFT substrate, an opposite substrate, and a liquid crystal layer sandwiched by the TFT and opposite substrates; and the backlight unit 2. The backlight unit 2, which is mounted at the back of the panel 4, irradiates white light to the panel 4 from its back.

A panel driver section 22 supplies a scanning signal S3 and a data signal S4 to a Y driver circuit (not shown) and a X driver circuit (not shown) of the LCD panel 4, respectively, in response to a timing signal S2 supplied from a timing controller (not shown). All the pixels existing in the screen of the panel 4 are scanned from the top end of the screen to the bottom end thereof by the scanning signal S3. In synchronization with the said scanning, image data corresponding to the data signal S4 are respectively supplied to the corresponding pixels. The panel 4 is driven in this way to display images corresponding to the scanning and data signals S3 and S4.

The backlight unit 20 according to the first embodiment of the invention comprises a light source 5 including a plurality of LEDs; a light-source driver section 21 for driving the LEDs of the light source 5 by supplying the predetermined LED driving currents to the said LEDs, a backlight controller section 20 for controlling the light-source driver section 21 by supplying LED control signals S6 to the section 21 in response to the timing signal S2; and a black signal supplier section 23 for supplying a black inserting signal (or black signal) S5 to the backlight controller section 20 and the panel driver section 22. Output signals S1 of photosensors 13 serving as chromaticity sensors (i.e., chromaticity detection signals) are inputted into the backlight controller section 20, where each of the photosensors 13 detects the chromaticity of the light irradiated from the corresponding LEDs of the light source 5.

Figure 4:
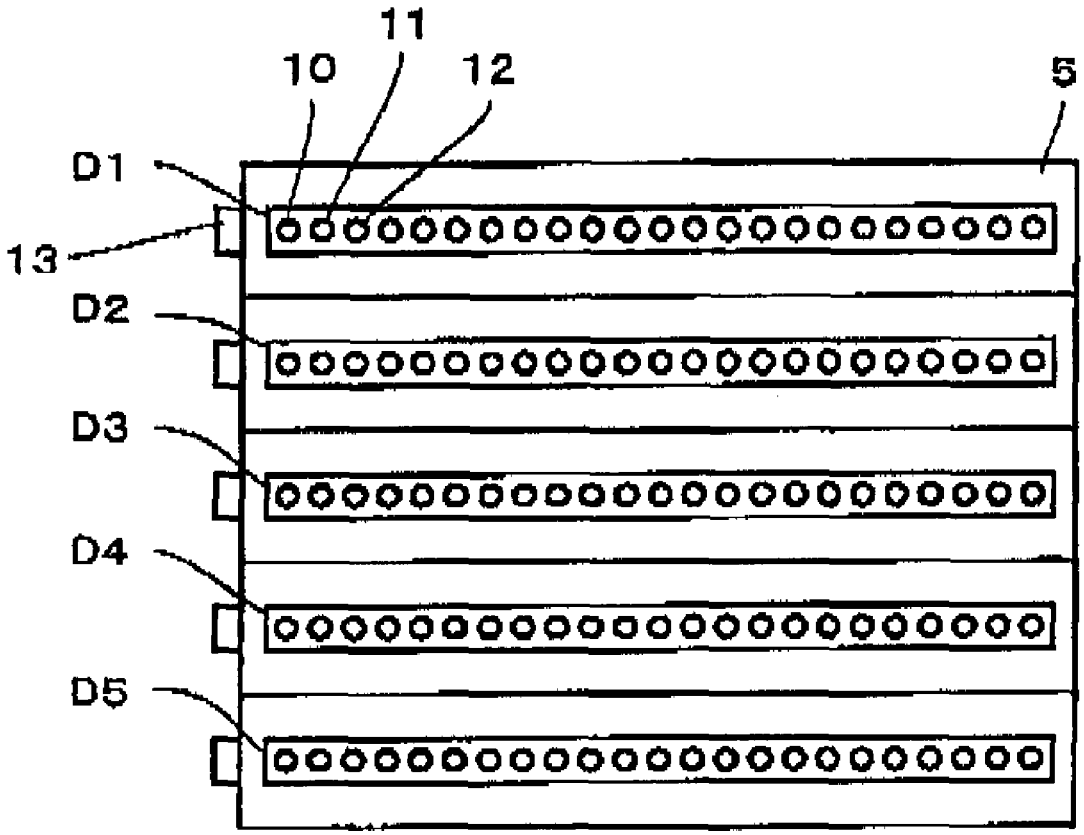
FIG. 4 is a schematic illustration showing the structure of the light source of the backlight unit according to the first embodiment of the present invention.

The light source 5 has a rectangular plan shape, as shown in FIG. 4, in which five belt-shaped LED units D1 to D5 are arranged in parallel at predetermined intervals from the top of the light source 5 to the bottom thereof. These LED units D1 to D5 have the same structure. Each of the LED units D1 to D5 comprises red LEDs 10, green LEDs 11, and blue LEDs 12, which are aligned on a straight line.

In each of the LED units D1 to D5, all the LEDs of the same color are electrically connected in series. For example, regarding the LED unit D1, all the red LEDs 10 in the unit D1 are electrically connected in series, all the green LEDs 11 in the unit D1 are electrically connected in series, and all the blue LEDs 12 in the unit D1 are electrically connected in series. Such the electrical connection of the LED unit D1 is applied to each of the other LED units D2 to D5.

The light source 5 is structured in such a way that the lights emitted from the red, green and blue LEDs 10, 11, and 12 arranged regularly in this way will be mixed with each other at a constant intensity ratio to generate white light. The white light thus generated is irradiated to the LCD panel 4 from the back thereof.

The light-emitting surface of the light source 5 is divided into five light-emitting regions in accordance with the five LED units D1 to D5, as shown in FIG. 4. Light can be emitted from these five light-emitting regions separately. Therefore, for example, when light is emitted from the LED unit D1 placed at the uppermost position, the backlight (white light) is emitted only from the laterally-extending, elongated region (the ⅕ light-emitting region) placed at the uppermost position of the light source 5 corresponding to the LED unit D1. At this time, the white light as the backlight is irradiated only to the laterally-extending, elongated region (i.e., the ⅕ display region) corresponding to the said ⅕ light-emitting region of the light source 5. The said ⅕ display region is placed at the uppermost position of the screen of the LCD panel 4.

The above explanation about the LED unit D1 is applied to each of the other LED units D2 to D5.

The LED units D1 to D5 comprise the corresponding photosensors 13 serving as the chromaticity sensors, respectively. The photosensors 13 provided respectively for the LED units D1 to D5 detect the chromaticities of the white lights irradiated from the LED units D1 to D5 separately and then, output their chromaticity detection signals S1 thus obtained to the backlight control section 20 in accordance with their chromaticity values thus detected.

The backlight control section 20 sends the LED control signals S6, which have been adjusted to have the predetermined chromaticity values, to the light-source driver section 21 based on the chromaticity detection signals S1 sent from the respective photosensors 13. In response to the LED control signals S6 thus received, the light-source driver section 21 adjusts the amounts and the supply and interruption timing (i.e., the ON/Off timing) of the LED driving currents. The LED driving currents thus adjusted will be supplied to the red LEDs 10, the green LEDs 11, and the blue LEDs 12 of the LED units D1 to D5 of the light source 5, respectively.

In this way, the backlight control section 20 feedback-controls the amounts of the LED driving currents to be supplied to the LEDs 10, 11, and 12 of the respective colors, using the chromaticity detection signals S1, thereby keeping the white light irradiated from the light source 5 at the predetermined chromaticity value.

With the backlight unit 20, as described above, light can be sequentially emitted from the five light-emitting regions to perform the "scan" type lighting by sequentially turning on and off the LED units D1 to D5 in one frame. Therefore, the lighting of the backlight unit 20 can be brought close to the "impulse" type lighting like a Cathode-Ray Tube (CRT).

The black signal supplier section 23 generates the black inserting signal (or black signal) S5 at the predetermined timing according to the timing signal S2 and then, supplies the signal S5 thus generated to the backlight controller section 20 and the panel driver section 22. The black inserting signal S5 is a signal to be inputted into all the pixels of the LCD panel 4 along with the image signal at the different timing shifted from that of the image signal in one frame. The black inserting signal S5 is to shorten the light-emitting time of the corresponding pixels (i.e., the image display time) by displaying black on the screen subsequent to the image corresponding to the image signal in one frame.

In this way, since the "black write type display" is performed by the black signal supplier section 23, the light-omitting times are shortened for all the pixels. As a result, the lighting of the backlight unit 20 can be approximated to the pseudo "impulse" type lighting in cooperation with the scan type lighting of the LED units D1 to D5. This means that the display quality degradation, such as the contour blur of time-varying images, the afterimage, and so on when time-varying images are displayed can be prevented and the quality of time-varying images can be improved.

The supply and interruption timing of the LED driving currents to be supplied from the light source driver section 21 to the LED units D1 to D5 is determined by the LED control signals S6 sent from the backlight controller section 20. The LED control signals S6 are generated based on the chromaticity detection signals S1 sent from the photosensors 13, the timing signal S2 extracted from the image signal, and the black inserting signal S5 supplied from the black signal supplier section 23. Each of the LED units D1 to D5 is driven at the timing (i.e., by the pulsed waves) thus determined to perform the scan type lighting (i.e., the intermittent light emission).

Next, the operation of the backlight unit 20 having the above-described structure will be explained below with reference to FIGS. 5A to 5D.

Figure 5A:
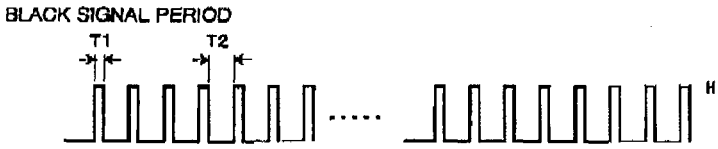
FIGS. 5A to 5D are timing diagrams showing the pulse generation timing of the black inserting signal, the scanning light-emitting signal, and the LED driving signal in the backlight unit according to the first embodiment of the present invention, and that of the LED driving signal of a variation thereof, respectively.

The black inserting signal S5, which is generated by the black signal supplier section 23 and supplied to the backlight controller section 20 and the panel driver 22, has the pulsed waveform shown in FIG. 5A. The waveform of FIG. 5A comprises pulse-shaped black signal periods T1 that are repeated every predetermined period T2 in synchronization with the timing signal S2 extracted from the image signal. This means that the black inserting signal S5 is outputted only in the respective black signal periods T1 where the black inserting signal S5 is in the logic high (H) level. In addition, as explained later, the black inserting signal S5 is used for generating an additional light-emitting signal.

Figure 5B:
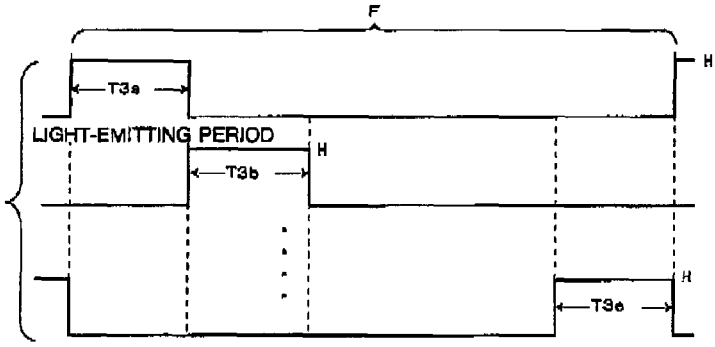

The scanning light-emitting signals, which are contained in the LED control signals S6 outputted to the light source driver section 21 by the backlight controller section 20, are five pulsed signals shown in FIG. 5B. These five signals shown in FIG. 5B correspond to the five LED units D1 to D5, respectively.

The first one of the five signals of FIG. 5B, which is placed at the uppermost position, is the scanning light-emitting signal supplied to the LED unit D1 located at the uppermost position of the light source 21. The waveform of this signal comprises in the frame F one light-emitting period T3*a* where the said scanning light-emitting signal is in the logic high level.

The second one of the five signals of FIG. 5B, which is placed at the second position from the top, is the scanning light-emitting signal supplied to the LED unit D2 located at the second position of the light source 21 from its top. The waveform of this signal comprises in the frame F one light-emitting period T3*b* where the said scanning light-emitting signal is in the logic high level. The light-emitting period T3*b* is situated at the position immediately after the light-emitting period T3*a*.

Although not shown in FIG. 5B, the third one of the five signals of FIG. 5B, which is placed at the third position from the top, is the scanning light-emitting signal supplied to the LED unit D3 located at the third position of the light source 21 from its top. The said waveform comprises in the frame F one light-emitting period T3*c* where the said scanning light-emitting signal is in the logic high level. The light-emitting period T3*c* is situated at the position immediately after the light-emitting period T3*b*.

Although not shown in FIG. 5B, the fourth one of the five signals of FIG. 5B, which is placed at the fourth position from the top, is the scanning light-emitting signal supplied to the LED unit D4 located at the fourth position of the light source 21 from its top. The said waveform comprises in the frame F one light-emitting period T3*d* where the said scanning light-emitting signal is in the logic high level. The light-emitting period T3*d* is situated at the position immediately after the light-emitting period T3*c*.

The fifth one of the five signals of FIG. 5B, which is placed at the fifth position from the top (i.e., the lowermost position), is the scanning light-emitting signal supplied to the LED unit D5 located at the fifth (or lowermost) position of the light source 21 from its top. The said waveform comprises in the frame F one light-emitting period T3*e* where the said scanning light-emitting signal is in the logic high level. The light-emitting period T3*e* is situated at the position immediately after the light-emitting period T3*d*.

The first to fifth scanning light-emitting signals of FIG. 5B are repeated every frame F.

In this way, the five scanning light-emitting signals contained in the LED control signals S6 are in the logic high level in light-emitting periods T3*a*, T3*b*, T3*c*, T3*d*, and T3*e* in the frame F. Each of the periods T3*a*, T3*b*, T3*c*, T3*d*, and T3*e* is equal in length to (⅕) of the frame F. The times at which the periods T3*a*, T3*b*, T3*c*, T3*d*, and T3*e* start are shifted gradually. Therefore, the LED units D1 to D5 are sequentially turned on and off at the differently shifted times equal to multiples of the (⅕) length of the frame F. All the LED units D1 to D5 are turned on and off within the frame F. Using these scanning light-emitting signals, the scan type lighting (the scan type light emission) of the LED units D1 to D5 is carried out.

Figure 5C:
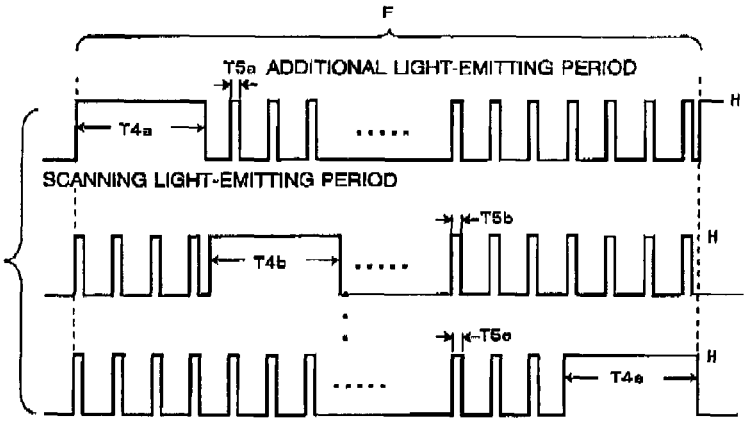

When the pulsed waveform of the black inserting signal S5 shown in FIG. 5A and the first to fifth waveforms of the scanning light-emitting signals (the five individual control signals) shown in FIG. 5B are subjected to the logic OR operation, the pulsed waveforms shown in FIG. 5C are obtained. These waveforms of FIG. 5C correspond to the five individual control signals (i.e., the LED driving signals) that constitute the LED control signals S6. However, only three signals for the LED units D1, D2 and D5 are shown in FIG. 5C.

The first one of the five waveforms of FIG. 5C, which is placed at the uppermost position, corresponds to the individual control signal (i.e., the LED driving signal) supplied to the LED unit D1 located at the uppermost position of the light source 21. The said waveform comprises in the frame F one scanning light-emitting period T4*a* and a plurality of pulse-shaped additional light-emitting periods T5*a*. All the additional light-emitting periods T5*a* are situated outside the scanning light-emitting period T4*a*. In the scanning light-emitting period T4*a* and the additional light-emitting periods T5*a*, the said LED driving signal is in the logic high level. The scanning light-emitting period T4*a* is equal in length to the light-emitting period T3*a* of FIG. 5B. Each of the additional light-emitting periods T5*a* is equal in length to the black signal period T1 of FIG. 5A.

When the first waveform of FIG. 5C is used, the LED unit D1 is repetitively turned on and off to emit light not only in the scanning light-emitting period T4*a* for the scan type lighting but also in the respective additional light-emitting periods T5*a* in the form of repetitive pulses.

The second one of the five waveforms of FIG. 5C, which is placed at the second position from the top, corresponds to the individual control signal (i.e., the LED driving signal) supplied to the LED unit D2 located at the second position of the light source 21 from its top. The said waveform comprises in the frame F one scanning light-emitting period T4*b* and a plurality of pulse-shaped additional light-emitting periods T5*b*. All the additional light-emitting periods T5*b* are situated outside the scanning light-emitting period T4*b*. In the scanning light-emitting period T4*b* and the additional light-emitting periods T5*b*, the said LED driving signal is in the logic high level. The scanning light-emitting period T4*b* is equal in length to the light-emitting period T3*b* of FIG. 5B. Each of the additional light-emitting periods T5*b* is equal in length to the black signal period T1 of FIG. 5A.

When the second waveform of FIG. 5C is used, the LED unit D2 is repetitively turned on and off to emit light not only in the scanning light-emitting period T4*b* for the scan type lighting but also in the respective additional light-emitting periods T5*b* in the form of repetitive pulses.

Although not shown, the third one of the five waveforms of FIG. 5C, which is placed at the third position from the top, corresponds to the individual control signal (i.e., the LED driving signal) supplied to the LED unit D3 located at the third position of the light source 21 from its top. The said waveform comprises in the frame F one scanning light-emitting period T4*c* and a plurality of pulse-shaped additional light-emitting periods T5*c*. All the additional light-emitting periods T5*c* are situated outside the scanning light-emitting period T4*c*. In the scanning light-emitting period T4*c* and the additional light-emitting periods T5*c*, the said LED driving signal is in the logic high level. The scanning light-emitting period T4*c* is equal in length to the light-emitting period T3*c*. Each of the additional light-emitting periods T5*c* is equal in length to the black signal period T1 of FIG. 5A.

When the third waveforms of FIG. 5C is used, the LED unit D3 is repetitively turned on and off to emit light not only in the scanning light-emitting period T4*c* for the scan type lighting but also in the respective additional light-emitting periods T5*c* in the form of repetitive pulses.

Although not shown, the fourth one of the waveforms of FIG. 5C, which is placed at the fourth position from the top, corresponds to the individual control signal (i.e., the LED driving signal) supplied to the LED unit D4 located at the fourth position of the light source 21 from its top. The said waveform comprises in the frame F one scanning light-emitting period T4*d* and a plurality of pulse-shaped additional light-emitting periods T5*d*. All the additional light-emitting periods T5*d* are situated outside the scanning light-emitting period T4*d*. In the scanning light-emitting period T4*d* and the additional light-emitting periods T5*d*, the said LED driving signal is in the logic high level. The scanning light-emitting period T4*d* is equal in length to the light-emitting period T3*d*. Each of the additional light-emitting periods T5*d* is equal in length to the black signal period T1 of FIG. 5A.

When the fourth waveform of FIG. 5C is used, the LED unit D4 is repetitively turned on and off to emit light not only in the scanning light-emitting period T4*d* for the scan type lighting but also in the respective additional light-emitting periods T5*d* in the form of repetitive pulses.

The fifth one of the waveforms of FIG. 5C, which is placed at the lowermost position, corresponds to the individual control signal (i.e., the LED driving signal) supplied to the LED unit D5 located at the lowermost position of the light source 21. The said waveform comprises in the frame P one scanning light-emitting period T4*e* and a plurality of pulse-shaped additional light-emitting periods T5*e*. All the additional light-emitting periods T5*e* are situated outside the scanning light-emitting period T4*e*. In the scanning light-emitting period T4*e* and the additional light-emitting periods T5*e*, the said LED driving signal is in the logic high level. The scanning light-emitting period T4*e* is equal in length to the light-emitting period T3*e* of FIG. 5B. Each of the additional light-emitting periods T5*e* is equal in length to the black signal period T1 of FIG. 5A.

When the fifth one of the waveforms (c) is used, the LED unit D5 is repetitively turned on to emit light not only in the scanning light-emitting period T4*e* for the scan type lighting but also in the respective additional light-emitting periods T5*e* in the form of repetitive pulses.

In this way, by using the five waveforms of FIG. 5C, the five LED units D1 to D5 are successively turned on and off to emit light at different pulse timing not only in the scanning light-emitting periods T4*a* to T4*e* but also in the respective additional light-emitting periods T5*a* to T5*e* in the form of repetitive pulses in the frame F. Accordingly, the overall quantity of the lights received by the photosensors 13 can be increased by the quantities corresponding to the lights received in the additional light-emitting periods T5*a* to T5*e*.

In addition, as explained above, each of the LED units D1 to D5 comprises the red LEDs 10, the green LEDs 11, and the blue LEDs 12. The LEDs 10, 11 and 12 of the three colors incorporated into each of the LED units D1 to D5 are driven to emit light at the same pulse timing.

With the backlight unit 2 according to the first embodiment of the present invention, as explained above, the scanning light-emitting signals and the additional light-emitting signal are supplied to the light source driver section 21 by the backlight controller section 20 responsive to the write scanning of the image signal to the LCD panel 4. Therefore, the red, green, and blue LEDs 10, 11, and 12 arranged in the five LED units D1 to D5 (i.e., the five light-emitting regions) are driven to emit red, green, and blue lights sequentially not only in the respective predetermined scanning light-emitting periods T4*a* to T4*e* but also in the respective additional light-emitting periods T5*a* to T5*e* in the single frame F. This means that the quantities of the lights emitted from the LEDs 10, 11, and 12 are greater than the case where the LEDs 10, 11, and 12 are driven to simply conduct the scanning operation in the respective scanning light-emitting periods T4*a* to T4*e*. For this reason, when the chromaticity sensors 13 detect the chromaticities of the white lights generated by the LEDs 10, 11, and 12 and then, the backlight controller section 20 adjusts the said white lights based on the chromaticity values obtained by the chromaticity sensors 13, the chromaticity values obtained by the chromaticity sensors 13 are higher. In other words, the necessary time for the chromaticity adjustment is shortened.

Accordingly, even if the LEDs 10, 11, and 12 are sequentially driven to conduct the scanning type light emission, the problem that it takes a long time from the time immediately after the turn on to the time the emitted lights are converged to the predetermined chromaticity does not occur. Moreover, the problem that a large chromaticity error will be generated when the convergence of the emitted lights is completed does not occur also.

Moreover, the light emission of the LEDs 10, 11, and 12 is carried out in each of the additional light-emitting periods T5*a* to T5*e* (which are respectively located outside the scanning light-emitting periods T4*a* to T4*e*) in synchronization with the supply of the optical leakage preventing signal (i.e., the black inserting signal) S5 to the LCD panel 4. Therefore, the display quality degradation, such as the contour blur of time-varying images, the afterimage, and so on can be prevented and the quality of time-varying images can be improved.

As a result, the necessary time from the time immediately after the turn on to the time the emitted white light is converged to the predetermined chromaticity can be shortened while the quality of time-varying images is improved.

With the LCD device 1 according to the first embodiment of the invention, the above-described backlight unit 2 is incorporated along with the LCD panel 4 and the panel driver section 22, as shown in FIG. 3. Therefore, the problem that the colors displayed on the screen will be inappropriate or improper at the time immediately after the turn on can be prevented while the quality of time-varying images is improved.

Variation of First Embodiment

In the above explanation, the individual control signals (i.e., the LED driving signals) supplied to the respective LED units D1 to D5 are designed to be in the logic high level in the scanning light-emitting periods T4*a* to T4*e* and the additional light-emitting periods T5*a* to T5*e*. However, the lengths of the scanning light-emitting periods T4*a* to T4*e* and the additional light-emitting periods T5*a* to T5*e* may be adjusted or varied using the PWM technique. If so, there is an additional advantage that the light-emitting periods of the LED units D1 to D5 can be controlled more precisely, which facilitates the attainment of white balance. The waveforms to be used in this case are shown in FIG. 5D.

Figure 5D:
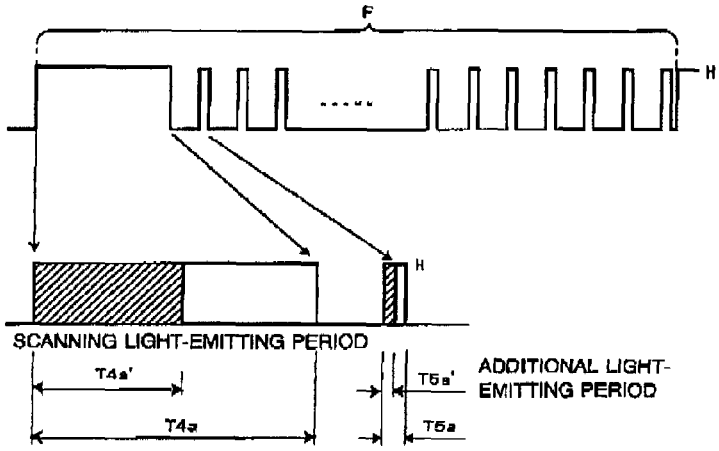

The waveform of FIG. 5D is an enlarged illustration of the waveform of the individual control signal (i.e., the LED driving signal) supplied to the LED unit D1 placed at the uppermost position of the light source 21 in the scanning light-emitting period T4*a* and the additional light-emitting period T5*a*.

As shown in FIG. 5D, the scanning light-emitting period T4*a* and the additional light-emitting period T5*a* are set as their maximum values, respectively. The actual scanning light-emitting period and the actual additional light-emitting period are respectively shortened to T4*a*' and T5*a*' according to the duty ratio, where T4*a*'≦T4*a*, T5*a*'≦T5*a*. For example, in a case where the duty ratio of the blue LEDs 12 is set at 50%, it is sufficient that the duty ratios of the green LEDs 11 and the red LEDs 10 are set at the same value (i.e., 50%) to attain the white balance, if the intensities of emitted light of the green LEDs 11 and the red LEDs 10 are equal to that of the blue LEDs 12. However, the intensities of emitted light of the red, green, and blue LEDs 10, 11, and 12 are generally unequal. Therefore, to attain the white balance, it is preferred that the chromaticity information obtained by the photosensors 13 is inputted into the backlight controller section 20 and then, the duty ratios are respectively set for the red, green, and blue LEDs 10, 11, and 12 in such a way that the intensities of emitted light of the LEDs 10, 11, and 12 are equal to each other.

In addition, the additional light-emitting periods T5*a* to T5*e* are not located in the horizontal and vertical blanking periods in the said variation of the first embodiment. This is applicable to the above-described first embodiment where the waveforms of FIG. 5C are used.

Second Embodiment

FIG. 6 is a timing diagram showing the waveforms of the signals used for driving the LED units D1 to D5 in a backlight unit according to a second first embodiment of the present invention.

The structure of the backlight unit according to the second embodiment is the same as the backlight unit 2 according to the first embodiment except that the waveforms of the signals used for driving the LED units D1 to D5 are different from those of the first embodiment.

In the above-described first embodiment, as shown in the waveforms of FIG. 5C, the additional light-emitting periods T5*a* to T5*e* are provided in the frame F corresponding to the individual black signal periods T1. However, the present invention is not limited to this. As shown by the waveforms of FIGS. 6A to 6C, the additional light-emitting periods may be located in the frame F corresponding to part of the black signal periods T1.

Figure 6A:
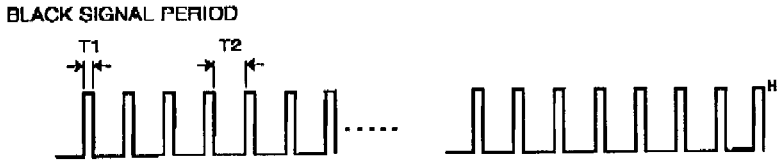
FIGS. 6A to 6C are timing diagrams showing the pulse generation timing of the black inserting signal, the scanning light-emitting signal, and the LED driving signal in a backlight unit according to a second first embodiment of the present invention, respectively.
Figure 6B:
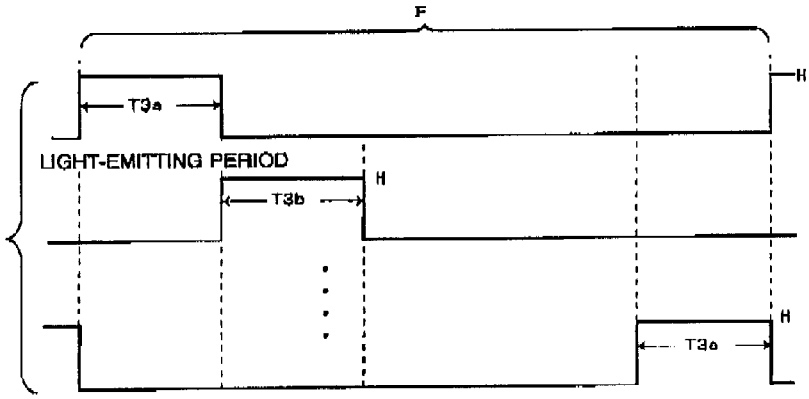
Figure 6C:
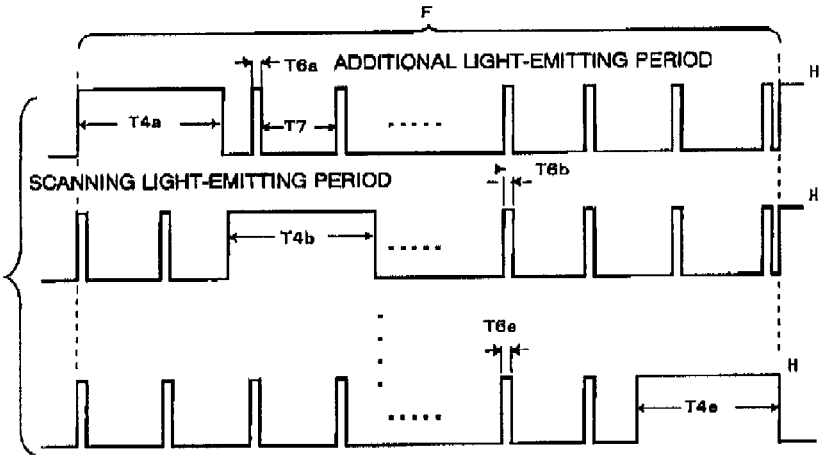

In the waveforms of FIGS. 6A to 6C, the same reference symbols are respectively attached to the same elements as those used in the waveforms of FIGS. 5A to 5C. The waveforms of the black inserting signal of FIG. 6A and the waveforms of the scanning light-emitting signals of FIG. 6B, which show the pulse generation timings of these signals, are the same as the waveforms of FIGS. 5A and 5B, respectively.

With the waveforms of the LED driving signals shown in FIG. 6C, the additional light-emitting periods T6*a* to T6*e* are provided alternately with respect to the additional light-emitting periods T5*a* to T5*e* shown in FIG. 5C (or the black inserting periods T1 shown in FIG. 5A). In other words, the interval T7 of the additional light-emitting periods T6*a* to T6*e* is approximately twice as long as the interval T2 of the black inserting periods T1.

With the backlight unit according to the second embodiment, the same advantages as those of the first embodiment are obtained except that the quantities of lights emitted from the LEDs 10, 11, and 12 (i.e., the quantities of lights received by the photosensors 13) are slightly reduced.

Other Embodiments

The above-described first and second embodiments and the variation of the first embodiment are preferred examples of the present invention. Therefore, needless to says the present invention is not limited to these embodiments and the variation, and any modification is applicable to them.

For example, a variety of black inserting methods, such as the method of inserting black signal periods into one horizontal period, and that of inserting black signal periods into one vertical period, are known. Any one of these known methods may be used for the invention if it includes periods for inserting black.

Moreover, although the black inserting signal is used as the optical leakage preventing signal S5 in the above-described first and second embodiments, the present invention is not limited to this. Any other signal may be used as the optical leakage preventing signal S5 if it prevents optical leakage.

Furthermore, although the red, green, and blue LEDs 10, 11, and 12 are driven to emit light based on the same pulse timing in the frame F in the above-described first and second embodiments, the invention is not limited to this. For example, the red, green, and blue LEDs 10, 11, and 12 may be separately driven in three different frames (or three different vertical periods) in such a way as to emit light of one color in each of the frames (or the vertical periods). In this case, it is preferred that the lights emitted from the LEDs 10, 11, and 12 are separately detected by the three photosensors 13. If so, white balance can be adjusted in such a way that the lights from the LEDs 10, 11, and 12 are appropriately mixed to be white light based on the detected values by the photosensors 13.

Figure 7:
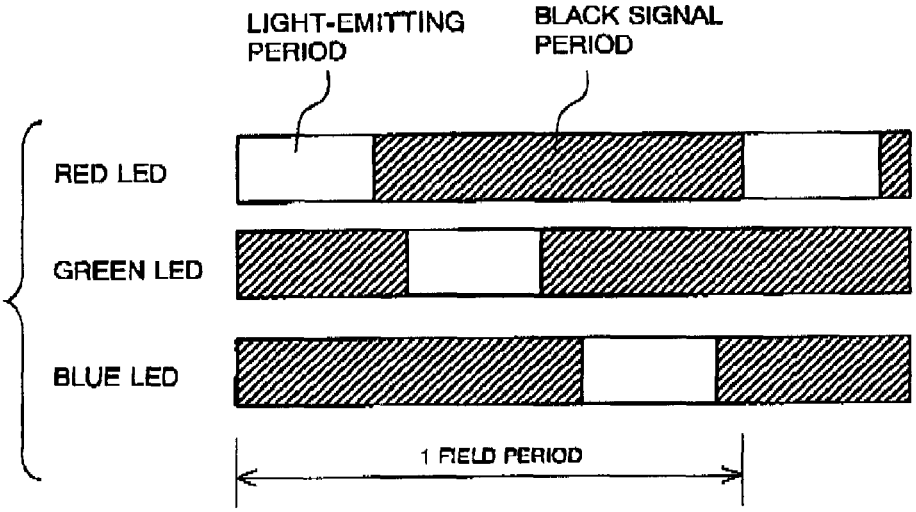
FIG. 7 is a timing diagram showing an example of the light-emitting timing of the red, green, and blue LEDs in the backlight unit according to the first and second embodiments of the present invention, where the red, green, and blue LEDs emit lights at different timing in one field period.

FIG. 7 shows an example of the waveforms for driving separately the red, green, and blue LEDs 10, 11, and 12 in the backlight unit according to the first and second embodiments of the invention. In this example, the red, green, and blue LEDs 10, 11, and 12 are driven to emit red, green, and blue lights at different timing in one field period (i.e., one vertical period), respectively. Specifically, during one field period, first, only the red LEDs 10 emit red lights in their light-emitting period; subsequently, only the green LEDs 11 emit green lights in their light-emitting period and finally, only the blue LEDs 12 emit blue lights in their light-emitting period.

Needless to say, the red, green, and blue LEDs 10, 11, and 12 may be driven to emit lights at different frames in a similar manner to this example.

The example in FIG. 7 is realized by adding the black inserting signal (i.e., the black signal periods) at different timing to the scanning light-emitting signals that cause continuous light emission of the respective LEDs 10, 11, and 12, thereby generating the light-emitting periods intermittently. In this case, if the lights of red, green, and blue colors from the LEDs 10, 11, and 12 are separately detected by the three photosensors 13 for adjusting the white balance, the necessary time for attainment of the white balance can be reduced.

While the preferred forms of the present invention have been described, it is to be understood that modifications will be apparent to those skilled in the art without departing from the spirit of the invention. The scope of the present invention, therefore, is to be determined solely by the following claims.

What is claimed is:

1. A backlight unit comprising:

a light source including LEDs of three or more colors, the LEDs being assigned to a plurality of light-emitting regions;

a chromaticity sensor for detecting a chromaticity of white light generated by the LEDs;

a light-source driver section for driving the LEDs; and a backlight controller section for adjusting white light generated by the LEDs to have a predetermined chromaticity based on a detected chromaticity value by the chromaticity sensor; and a black signal supplier section for supplying a black inserting signal for causing an LCD panel to display black in a black signal period, the black inserting signal being sent to the backlight controller section;

wherein the backlight controller section controls to drive the LEDs to emit lights sequentially in respective predetermined scanning light-emitting periods in a single frame and in respective additional light-emitting periods in the same frame responsive to write scanning of an image signal to the LCD panel, the additional light-emitting periods being outside a corresponding one of the scanning light-emitting periods;

light emission of the LEDs in each of the additional light-emitting periods is performed in synchronization with supply of a black inserting signal from the black signal supplier section to the LCD panel;

the additional light-emitting period is defined based on the black signal period, and the scanning light-emitting period is provided for scan type lighting;

light emission of the LEDs in the respective additional light-emitting periods in the frame is performed in a time period from a time immediately after a turn on to a time the emitted white light is converged to the predetermined chromaticity; and the time period is shortened by the light emission of the LEDs in the respective additional light emitting periods.

2. The backlight unit according to claim 1, wherein each of the additional light-emitting periods is set to be equal to a black signal period where the black inserting signal for causing the LCD panel to display black is generated.

3. The backlight unit according to claim 1, wherein each of the additional light-emitting periods is defined to be variable based on the black signal period where the black inserting signal for causing the LCD panel to display black is generated.

4. The backlight unit according to claim 3, wherein each of the additional light-emitting periods is set to be equal to or shorter than the black signal period.

5. The backlight unit according to claim 1, wherein each of the additional light-emitting periods is defined based on the black signal period where the black inserting signal for causing the LCD panel to display black is generated; and one of the additional light-emitting periods corresponds to a plurality of the black signal periods.

6. The backlight unit according to claim 1, wherein the LEDS of the light source include red, green, and blue LEDs, and the red LEDs, the green LEDs, and the blue LEDs are respectively driven to emit lights separately in different frames.

7. The backlight unit according to claim 1, wherein the LEDs of the light source include red, green, and blue LEDs; and the red LEDs, the green LEDs, and the blue LEDs are respectively driven to emit lights in the same frame.

8. The backlight unit according to claim 1, wherein waveforms of signals for driving the LEDs are equal to waveforms generated by a logical OR operation between waveforms for causing the LEDs to emit lights sequentially in the respective predetermined scanning light-emitting periods responsive to the write scanning of an image signal to the LCD panel, and a waveform of the black inserting signal for causing the LCD panel to display black.

9. A LCD device comprising: the backlight unit according to claim 1.

* * * * *